US010472863B2

(12) United States Patent
Mazal et al.

(10) Patent No.: US 10,472,863 B2
(45) Date of Patent: Nov. 12, 2019

(54) LOCK WITH ACCUMULATOR LEVER FOR A MOTOR VEHICLE

(71) Applicant: Kiekert AG, Heiligenahus (DE)

(72) Inventors: Radek Mazal, Chleny (CZ); Jan Zejda, Chrudim (CZ)

(73) Assignee: Kiekert AG, Heiligenahus (DE)

( * ) Notice: Subject to any disclaimer, the term of this patent is extended or adjusted under 35 U.S.C. 154(b) by 448 days.

(21) Appl. No.: 15/033,772

(22) PCT Filed: Oct. 9, 2014

(86) PCT No.: PCT/DE2014/100353
§ 371 (c)(1),
(2) Date: May 18, 2016

(87) PCT Pub. No.: WO2015/062578
PCT Pub. Date: May 7, 2015

(65) Prior Publication Data

US 2016/0265255 A1 Sep. 15, 2016

(30) Foreign Application Priority Data

Nov. 2, 2013 (DE) ..... 10 2013 018 451

(51) Int. Cl.
*E05B 77/16* (2014.01)
*E05B 83/18* (2014.01)
(Continued)

(52) U.S. Cl.
CPC ..... *E05B 77/16* (2013.01); *E05B 83/18* (2013.01); *E05B 83/24* (2013.01); *E05B 85/243* (2013.01); *E05B 85/26* (2013.01)

(58) Field of Classification Search
CPC ..... E05B 81/06; E05B 81/15; E05B 81/34; E05B 85/243; E05B 85/26; E05B 77/16;
(Continued)

(56) References Cited

U.S. PATENT DOCUMENTS 1,411,734 A * 4/1922 Klossner ..... B65D 43/0222 217/89
1,936,232 A * 11/1933 Greene ..... E05C 17/52 292/194
(Continued)

FOREIGN PATENT DOCUMENTS

CN 202347958 U 7/2012
CN 102822433 A 12/2012
(Continued)

OTHER PUBLICATIONS

International Search Report for corresponding Patent Application No. PCT/DE2014/100353 dated Jun. 19, 2015.
(Continued)

*Primary Examiner* — Alyson M Merlino
(74) *Attorney, Agent, or Firm* — Renner, Otto, Boisselle & Sklar, LLP

(57) ABSTRACT

The invention concerns a lock, in particular for a motor vehicle bonnet extending horizontally at least in sections, with a locking mechanism consisting of a rotary latch (16) and a retaining pawl (1) for locking the rotary latch (16), with a release lever (2) for opening the locking mechanism, and with an accumulator lever (10) for temporarily holding the retaining pawl (1) in its open position while the locking mechanism is being opened, the accumulator lever (10) taking the form of a spring.

14 Claims, 12 Drawing Sheets

Figure 1:
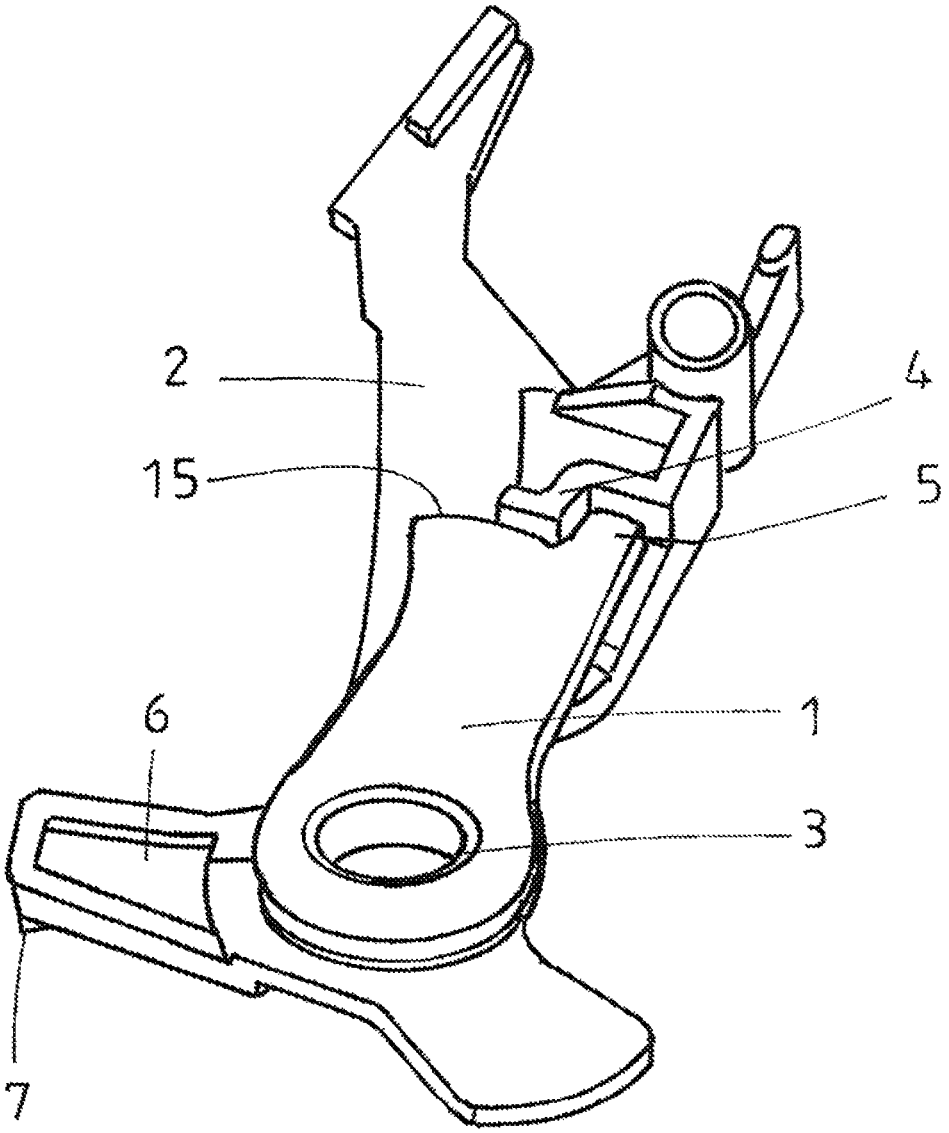

(51) Int. Cl.
*E05B 83/24* (2014.01)
*E05B 85/24* (2014.01)
*E05B 85/26* (2014.01)

(58) Field of Classification Search
CPC ..... E05B 83/18; E05B 83/24; E05B 83/16; Y10T 292/1047; Y10T 292/108; Y10T 292/1082; Y10S 292/16; Y10S 292/61; Y10S 292/23; Y10S 292/38
See application file for complete search history.

(56) References Cited

U.S. PATENT DOCUMENTS

| | | | | |
|---|---|---|---|---|
| 6,364,379 | B1 * | 4/2002 | Roberts | E05B 83/16 292/216 |
| 8,348,310 | B2 | 1/2013 | Vázquez et al. | |
| 2002/0163207 | A1 * | 11/2002 | Rogers, Jr. | E05B 83/16 292/216 |
| 2003/0178858 | A1 * | 9/2003 | Spurr | E05B 83/16 292/217 |
| 2011/0031765 | A1 | 2/2011 | Vázquez et al. | |
| 2012/0292927 | A1 * | 11/2012 | Vazquez | E05B 85/26 292/200 |
| 2013/0256345 | A1 * | 10/2013 | Larkin | A45C 11/00 224/201 |
| 2014/0292000 | A1 * | 10/2014 | Vazquez | E05B 81/15 292/100 |
| 2018/0223568 | A1 * | 8/2018 | Cho | E05B 81/15 |

FOREIGN PATENT DOCUMENTS

| | | | |
|---|---|---|---|
| DE | 103 61 168 | A1 | 7/2005 |
| DE | 20 2012 002867 | U1 | 4/2012 |
| DE | 10 2013 107 000 | | 1/2015 |
| WO | 03/071065 | A1 | 8/2003 |
| WO | 2015/000460 | A1 | 1/2015 |

OTHER PUBLICATIONS

Written Opinion for corresponding Patent Application No. PCT/DE2014/100353 dated Jun. 22, 2015.
International Preliminary Report on Patentability for corresponding Patent Application No. PCT/DE2014/100353 dated May 3, 2016.
Office Action, and English Translation thereof, issued in counterpart Chinese Patent Application No. 201480059650.

* cited by examiner

LOCK WITH ACCUMULATOR LEVER FOR A MOTOR VEHICLE

The invention relates to a latch for a door or a flap and in particular for a hood of a motor vehicle. The latch demonstrates a locking mechanism comprising a catch and at least a pawl for latching of the catch. The latch is equipped with a triggering lever, with which the locking mechanism can be unlatched for opening of a pertaining door or flap. There is also an accumulator lever which directly or indirectly holds the pawl temporarily in its open position during opening. "Open position" means that the pawl does not latch the catch and the catch can thus be rotated from a closed position into an open position.

The purpose of a latch is for the temporary closure of openings in motor vehicles with the aid of doors or flaps. In the closed state of such a latch the pivoting film encompasses a bracket-shaped locking bolt in particular with two arms. In the case of a motor vehicle, the locking bolt can be attached to a door or a flap of the motor vehicle and then the latch to the chassis or vice versa. In the case of a motor vehicle, there are lateral door latches, tailgate latches and hood latches or engine hood latches in particular.

The latch regularly encompasses a latch case or a latch plate and a latch cover with the help of which the latch case is closed. The latch case and latch cover are known as a latch housing. The locking mechanism, i.e. pawl and catch, are pivotably attached to the latch case in principle. For stability reasons, the latch case, catch and/or pawl are made of metal in principle. The latch cover is usually made of plastic.

If the catch reaches a closed position by means of pivoting starting in an open position, the catch is ultimately latched by means of the pawl. Such a pivoting is attained by the locking bolt if it engages into the catch by closure of a pertaining door or flap. A locking area of the pawl is then adjacent to a locking area of the catch in the latched state, whereby the catch is prevented from being rotated back in the direction of the open position. The locking bolt can no longer leave the locking mechanism in the closed position.

For opening it is necessary to move the pawl out of its latching position. If the pawl has been moved out of its latching position; the catch rotates in the direction of the open position. In the open position of the catch and thus in the open position of the locking mechanism, the locking bolt can leave the lock. The door or flap can thus be opened again.

There are latches with two different latching positions of the catch. The catch can then initially be latched into the pre-latching position and finally into the so-called main latching position by a further rotation in the closure direction. In the pre-latching position, a locking bolt can no longer leave the locking mechanism. However, a relevant door or flap is not yet completely closed. Such a door or flap is only completely closed when the catch is rotated to the main latching position and latched into place here. A second pawl can be provided for latching into place in the pre-latching position. However, it is also possible to latch the catch with only one pawl both in the pre-latching position and in the main latching position.

There is an activation device to open a latch. The locking mechanism opens when the activation device is activated. A door handle or a flap can be part of the activation device. This handle is generally connected to a triggering lever of the latch via a rod or a Bowden cable. If the handle is activated, the triggering lever of the latch is pivoted by means of the rod or the Bowden cable in such a way that the pawl moves from its latching position to its open position, the catch then rotates into its open position in order to then be able to open a pertaining door or flap. A motor vehicle can demonstrate a generally pivotable external handle which can be accessed from outside, and/or a generally pivotable internal handle which can be accessed from inside.

The present invention is especially advantageous for flap-shaped hoods which are horizontally aligned at least in places in such a way that they can be covered with snow. A load effected thus (also known as a "snow load") prevents opening of such a flap, preferably a tailgate of a motor vehicle. Thus, a locking mechanism of a latch can thus be opened, i.e. unlatched. Due to the heavy snow load, however, the locking bolt (also known as "latch holder") may not move far enough out of the catch. Consequently, the pawl latches the catch again after opening. If a pre-latch is present, the pawl can thus latch on an unscheduled basis in the pre-latching position during opening. In order to prevent such a problem, an accumulator element is envisaged for example in the form of an accumulator lever which temporarily holds the pawl in its open position during opening. Consequently, the pawl cannot be latched in the catch on an unscheduled basis. In this case, an accumulator lever means that the open position of the pawl can be held or accumulated. Such a latch with an accumulator element is known, for example, from U.S. Pat. No. 8,348,310 B2.

An accumulator lever or accumulator element formed from the latch housing for a tailgate latch is described in the German patent registration 10 2013 107 000. The accumulator element known from this holds the pawl of the latch in the raised position until the catch is open.

Insofar as not stated otherwise hereinafter, the object of the invention can demonstrate the aforementioned characteristics individually or in any combination.

It is a task of the invention to further develop a latch of the aforementioned type which can be reliably opened even in the case of impairment by a load such as a snow load, for example.

In order to solve the task, a latch in particular for a horizontal hood or flap of a motor vehicle at least in places, with a locking mechanism comprising a catch and a pawl, is provided for latching of the catch. The latch encompasses a triggering lever for opening of the locking mechanism and an accumulator lever for temporary holding of the pawl in its open position during opening of the locking mechanism. The latch demonstrates a latch cover made of plastic in principle. The accumulator lever is created in such a way that it is able to hold the triggering lever temporarily in its open position during opening of the locking mechanism. The accumulator lever is preferably designed as a spring. The accumulator lever therefore consists of an elastic material and of an elastic plastic material in particular. One end of the accumulator lever can be pivoted solely due to its elastic characteristics. This enables simple manufacture inter alia as the accumulator lever can, for example, be connected with the latch cover as a single component. It is not necessary to create a pivotable mounting for the accumulator lever in order to be able to pivot the accumulator lever. Furthermore, this enables a compact design. Such a latch can be reliably opened even in the event of a load which impacts on a door or flap as an unscheduled engagement of the pawl into a latching position or latch position is prevented by the accumulator lever.

The accumulator lever is pivoted in one execution form parallel to the pivoting plane of the locking mechanism and/or parallel to the external wall of the latch cover for temporary holding of the pawl. Pivoting in such a plane enables an additional pre-tensioned spring, in particular a leg spring, which suitably assists the desired behavior of the accumulator lever, in a technically simple manner. In particular, the leg spring exerts such a force on the accumulator lever which is capable of pivoting the accumulator lever into the position in which the accumulator lever holds the pawl in the open position. As a spring is a conventionally available component, the associated technical expense is low. The spring is preferably made of metal as a stable and small spring can thus be provided with which an adequately large force can be exerted on the accumulator lever. The spring thus advantageously supports springy characteristics of the accumulator lever and prevents malfunctions due to signs of fatigue, for example, due to temperature-induced signs of fatigue.

The accumulator lever is connected with the latch cover of the latch in a single component in one execution form for manufacture with low technical expenditure.

Other execution forms and advantages are illustrated by the examples described below.

Figure 2:
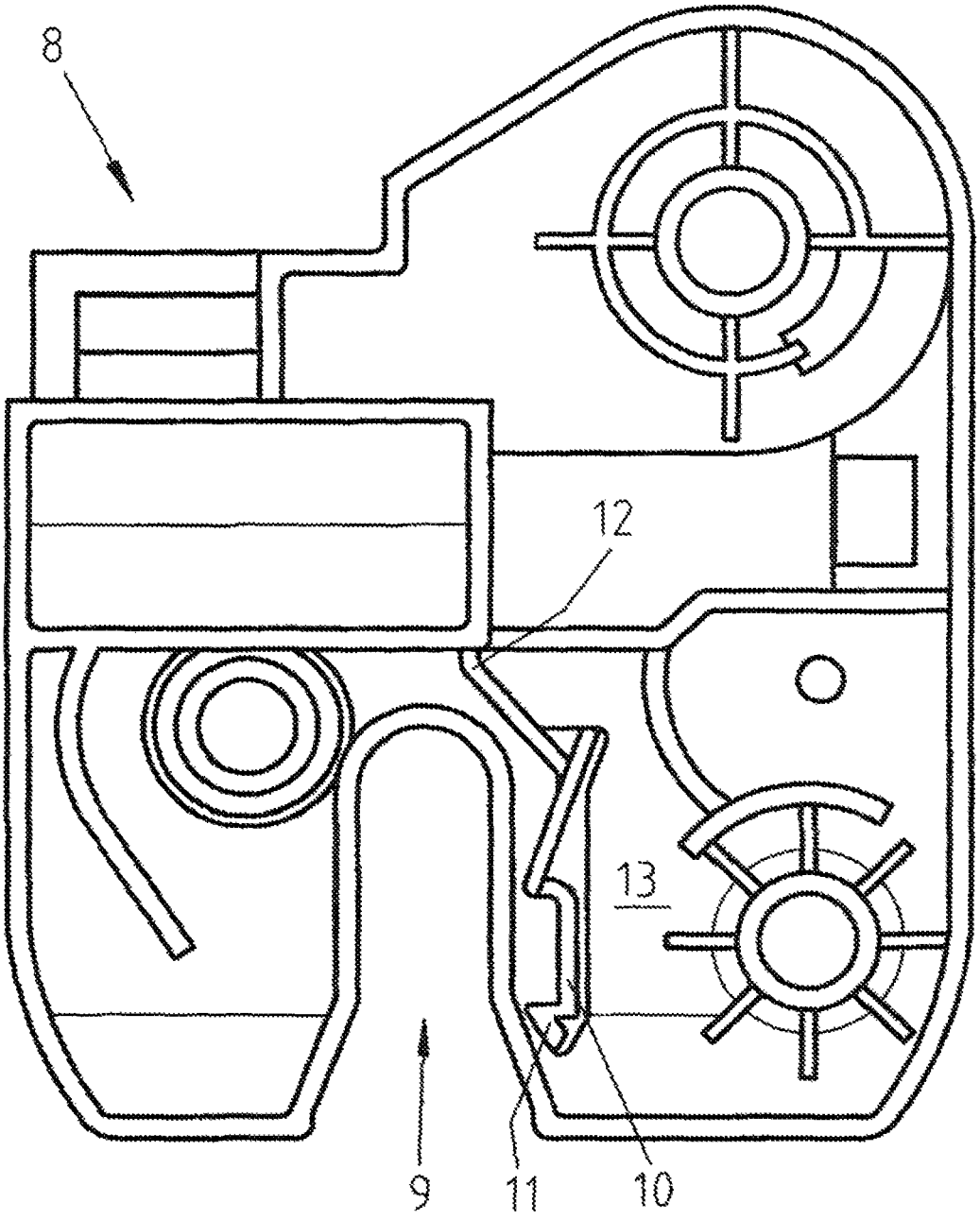
Figure 3:
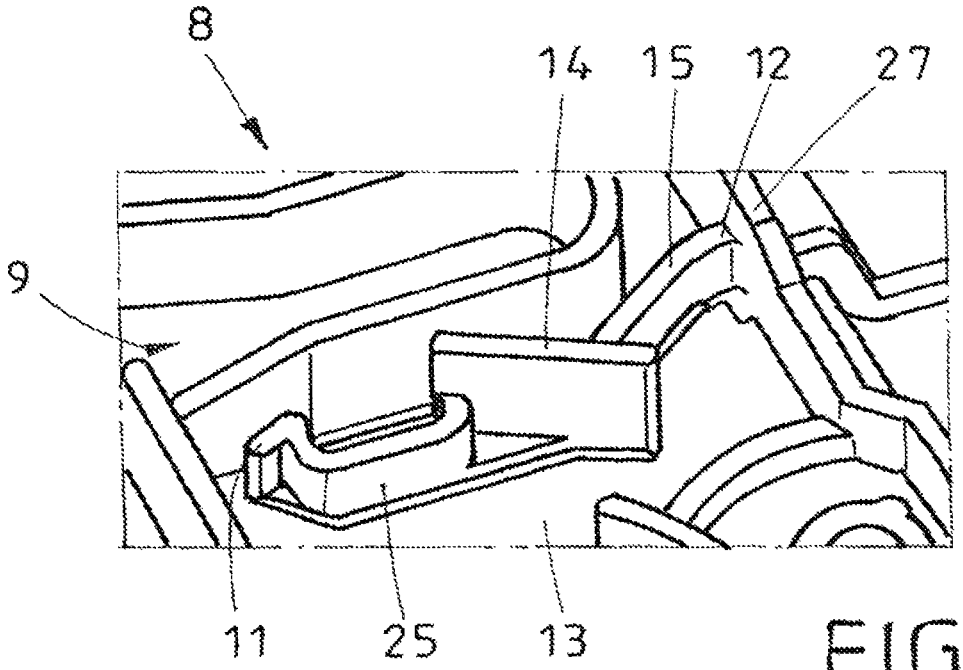
Figure 4:
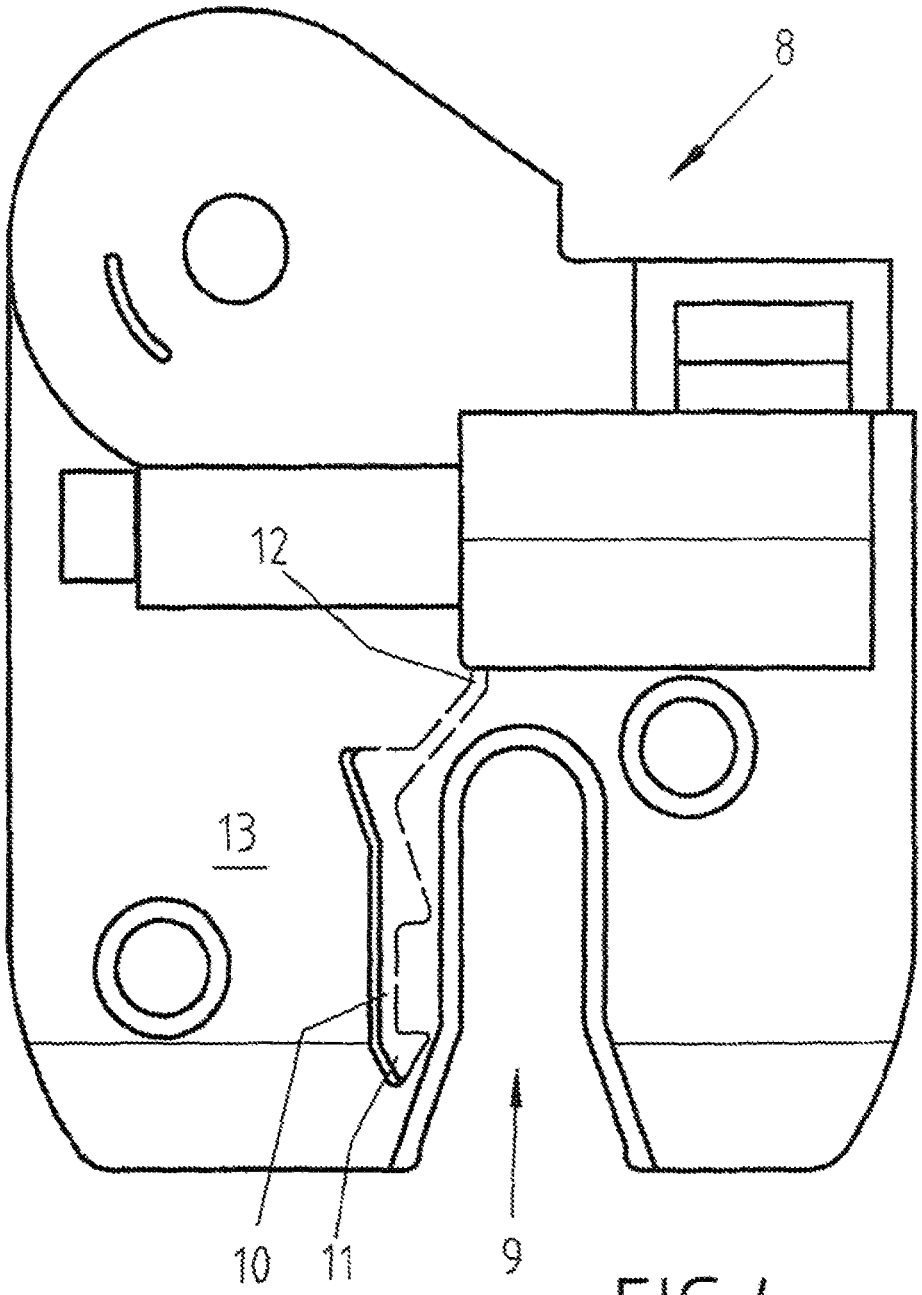
Figure 5:
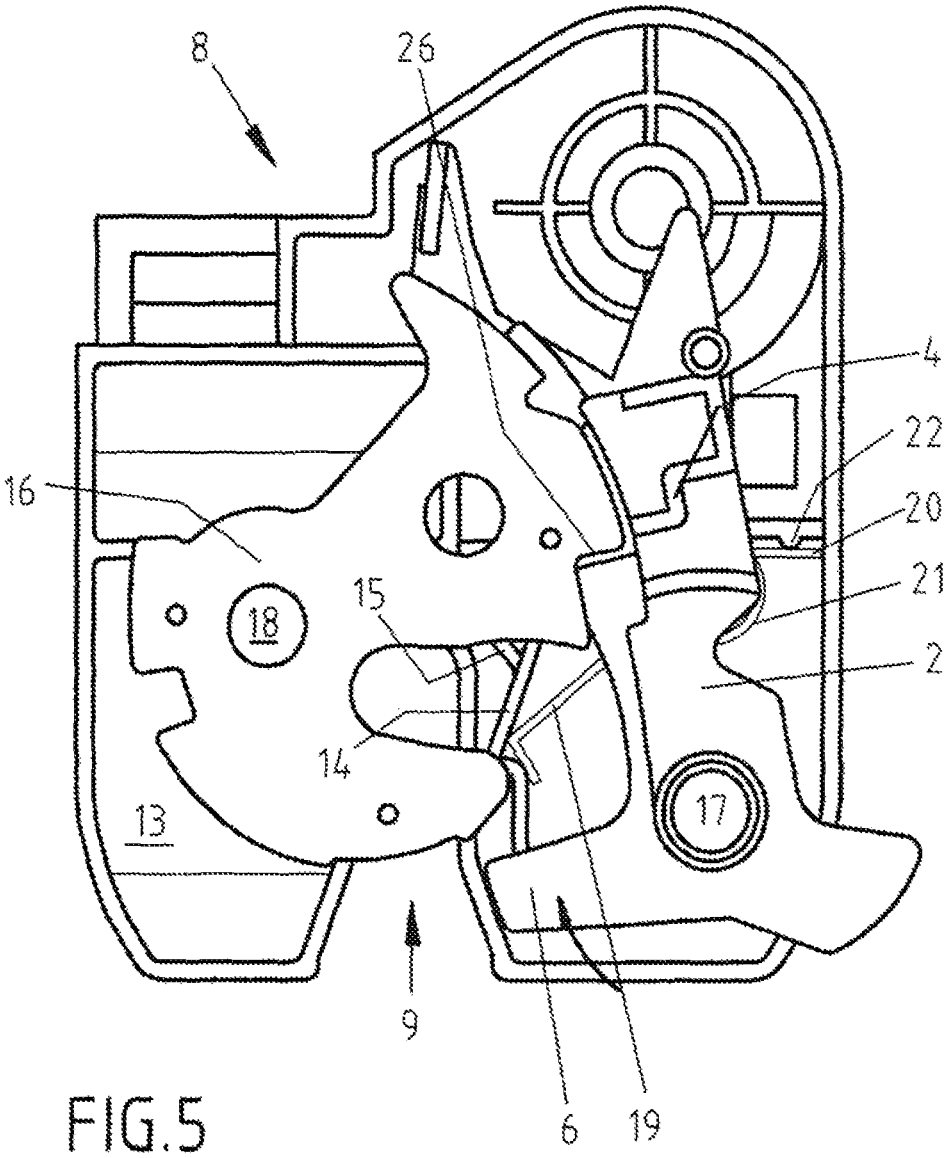
Figure 6:
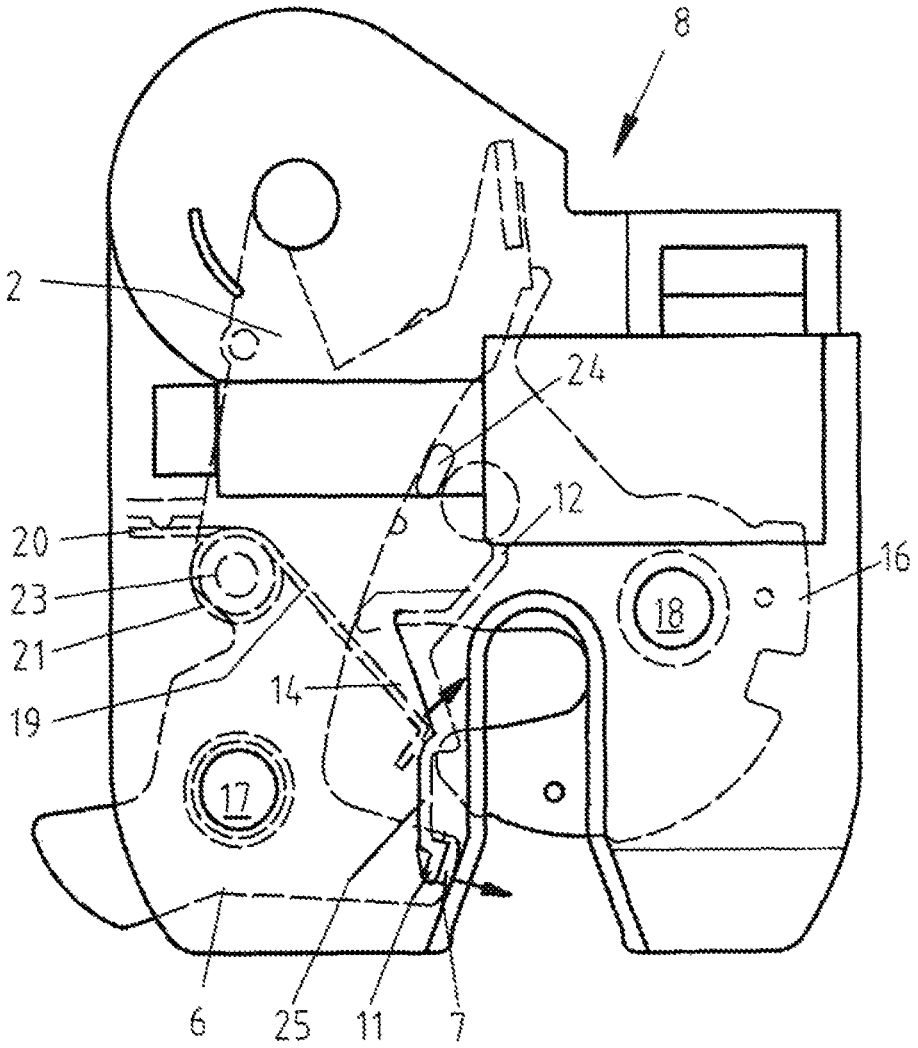
Figure 7:
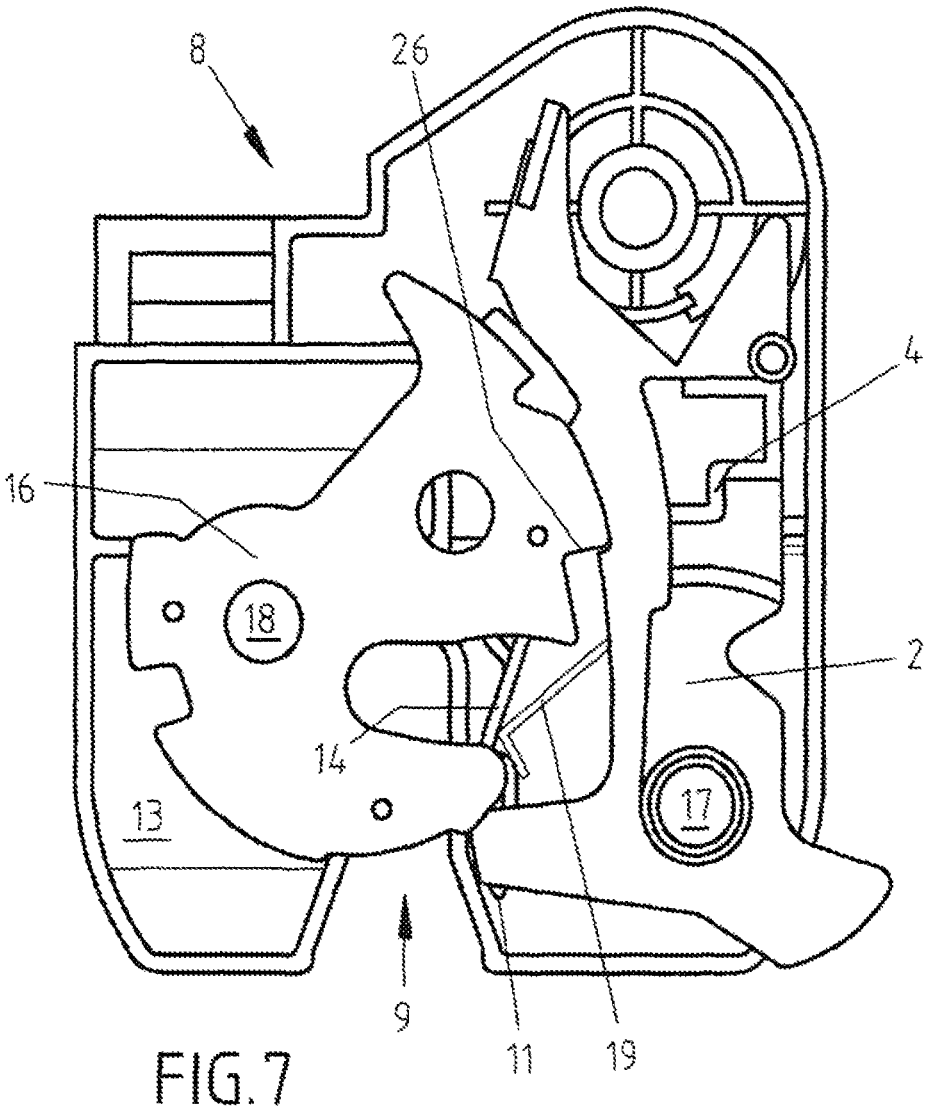

The following are shown:

FIG. 1: Triggering lever with pawl;

FIG. 2: Front view on a latch cover;

FIG. 3: Extract of a perspective view of the latch cover corresponding to the front view;

FIG. 4: Back view on the latch cover;

FIG. 5: Front view on the latch in the latched state;

FIG. 6: Back view on the latch in the latched state;

FIG. 7: Front view on the latch during opening of the locking mechanism

Figure 8:
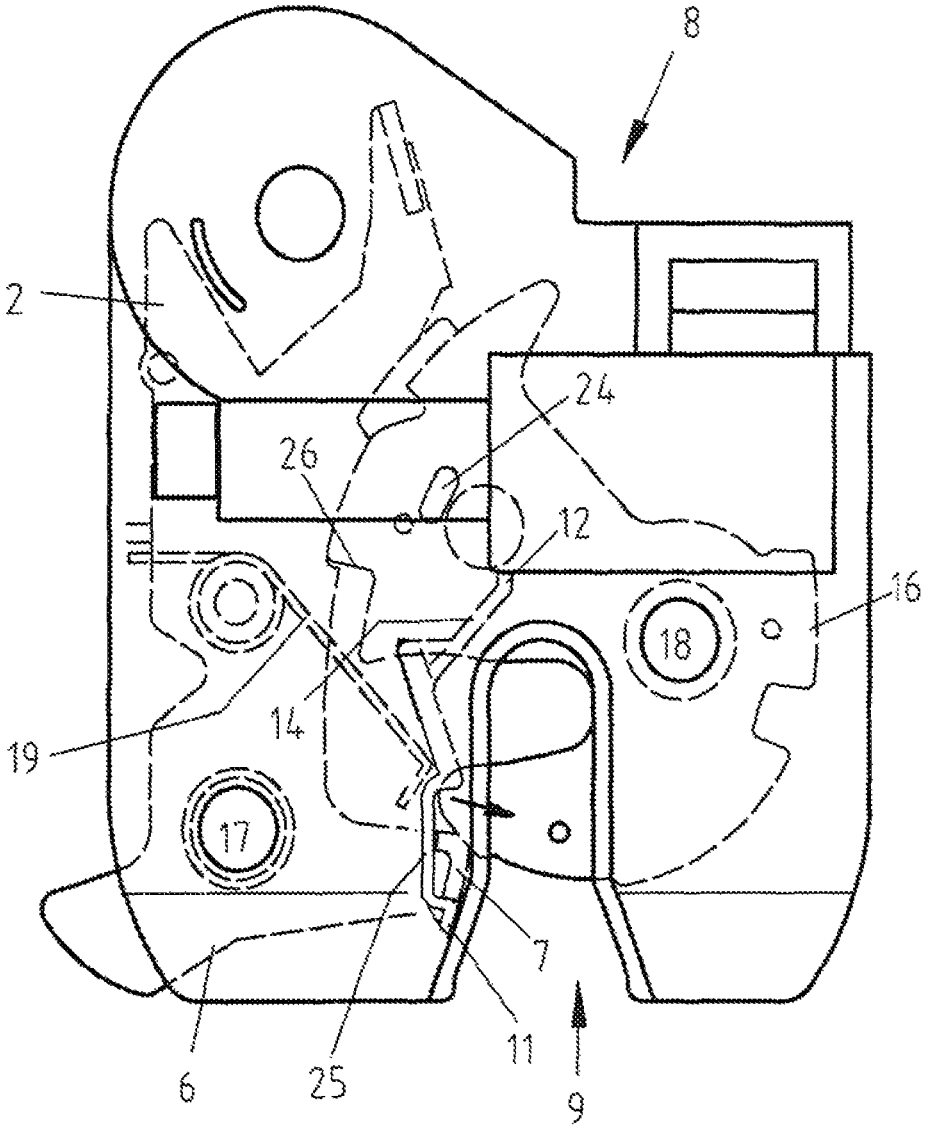
Figure 9:
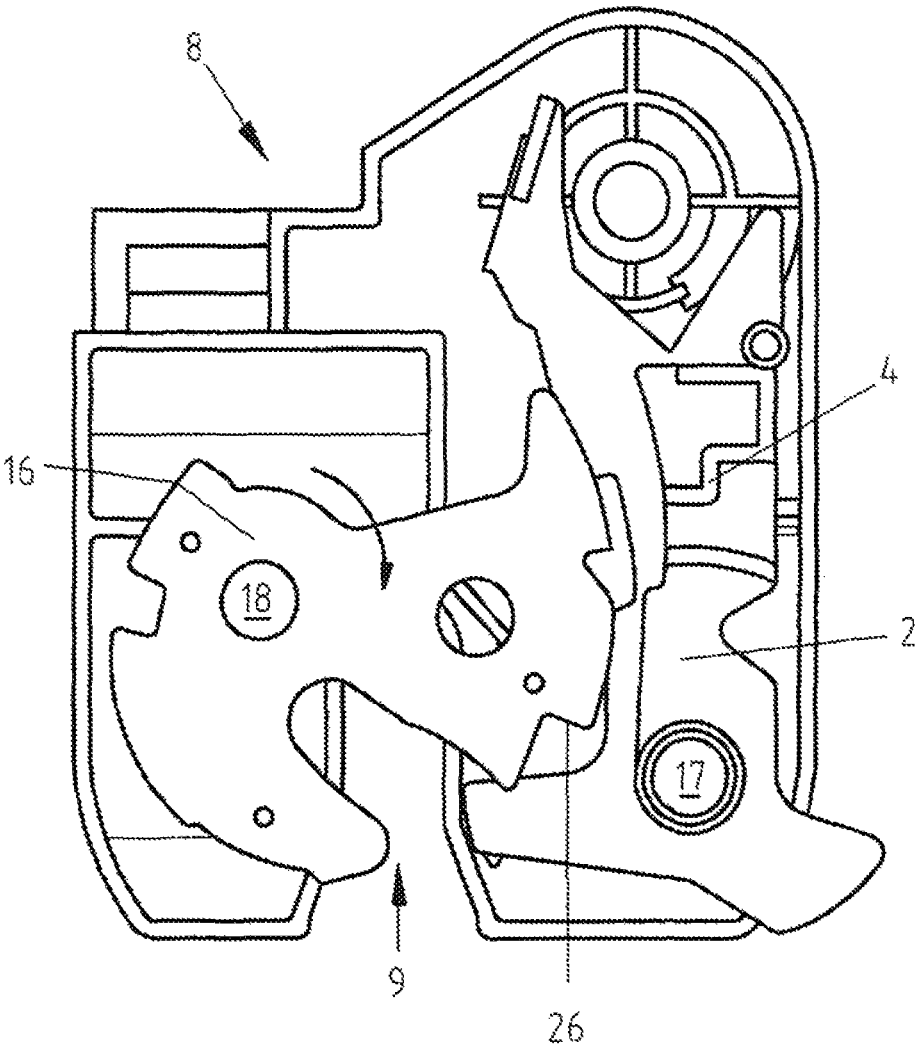
Figure 10:
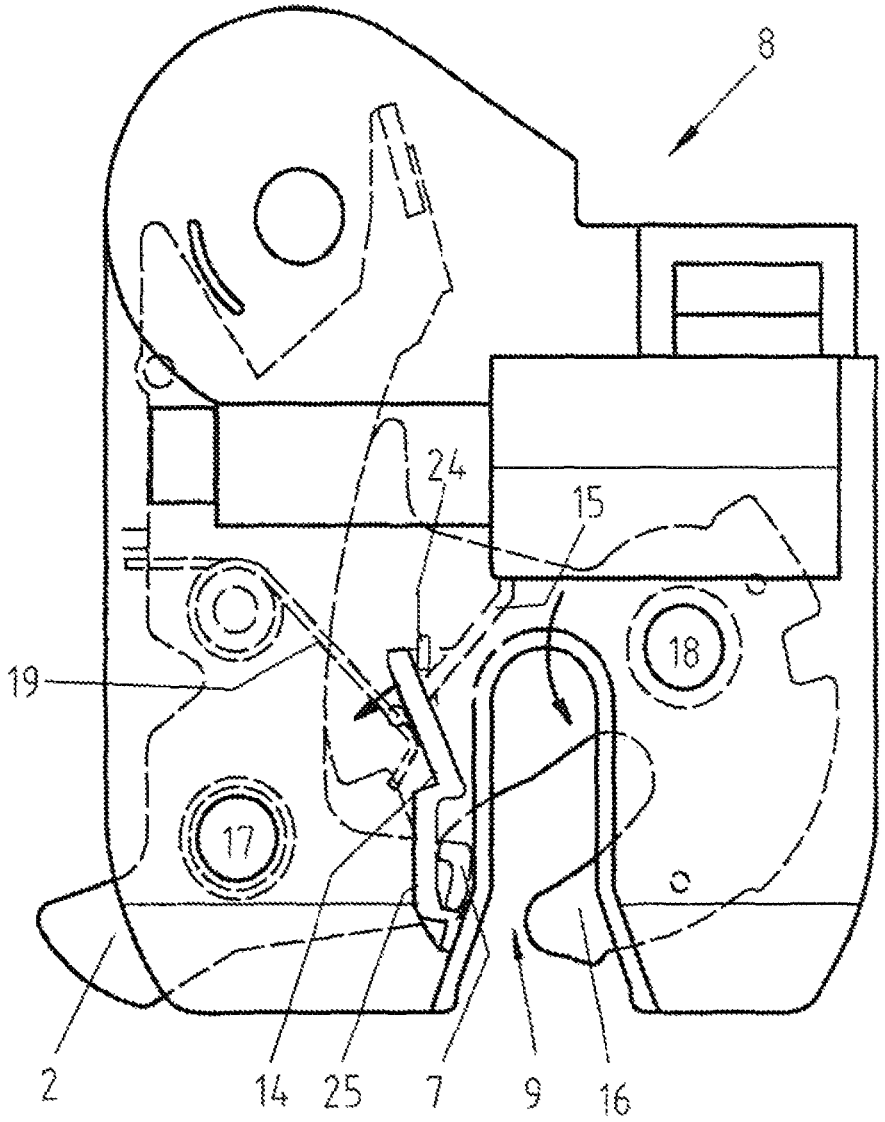
Figure 11:
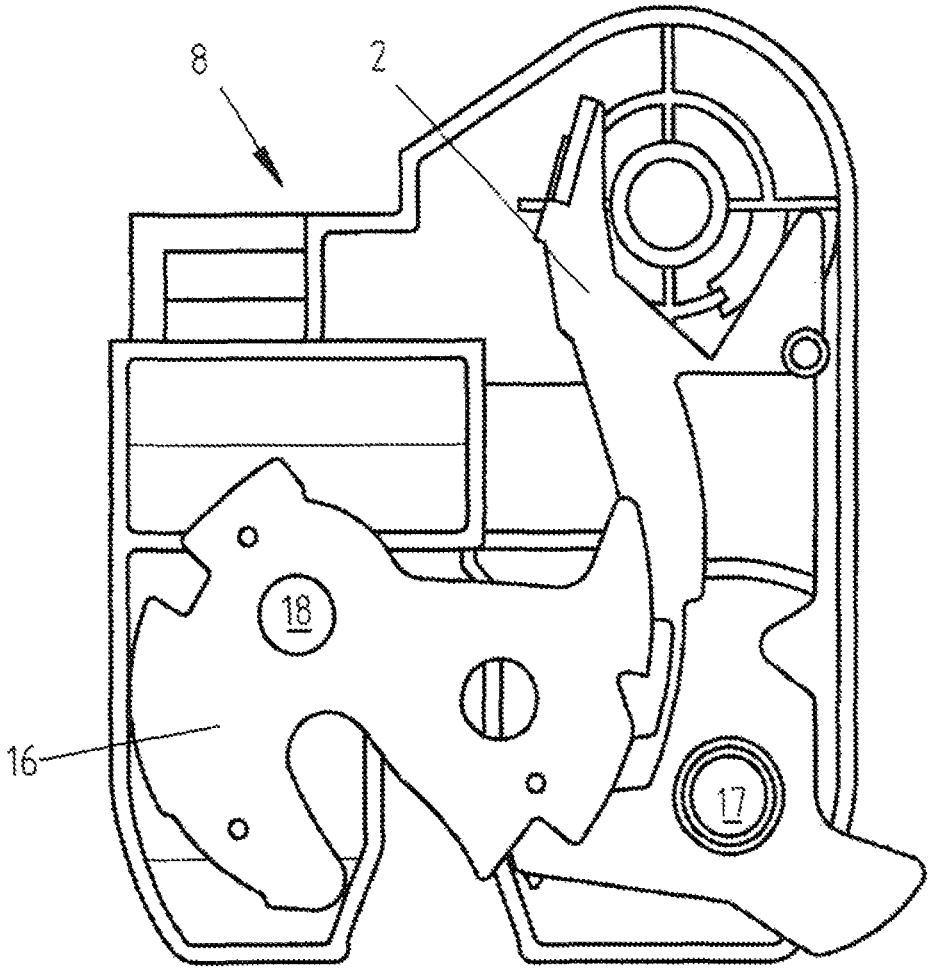
Figure 12:
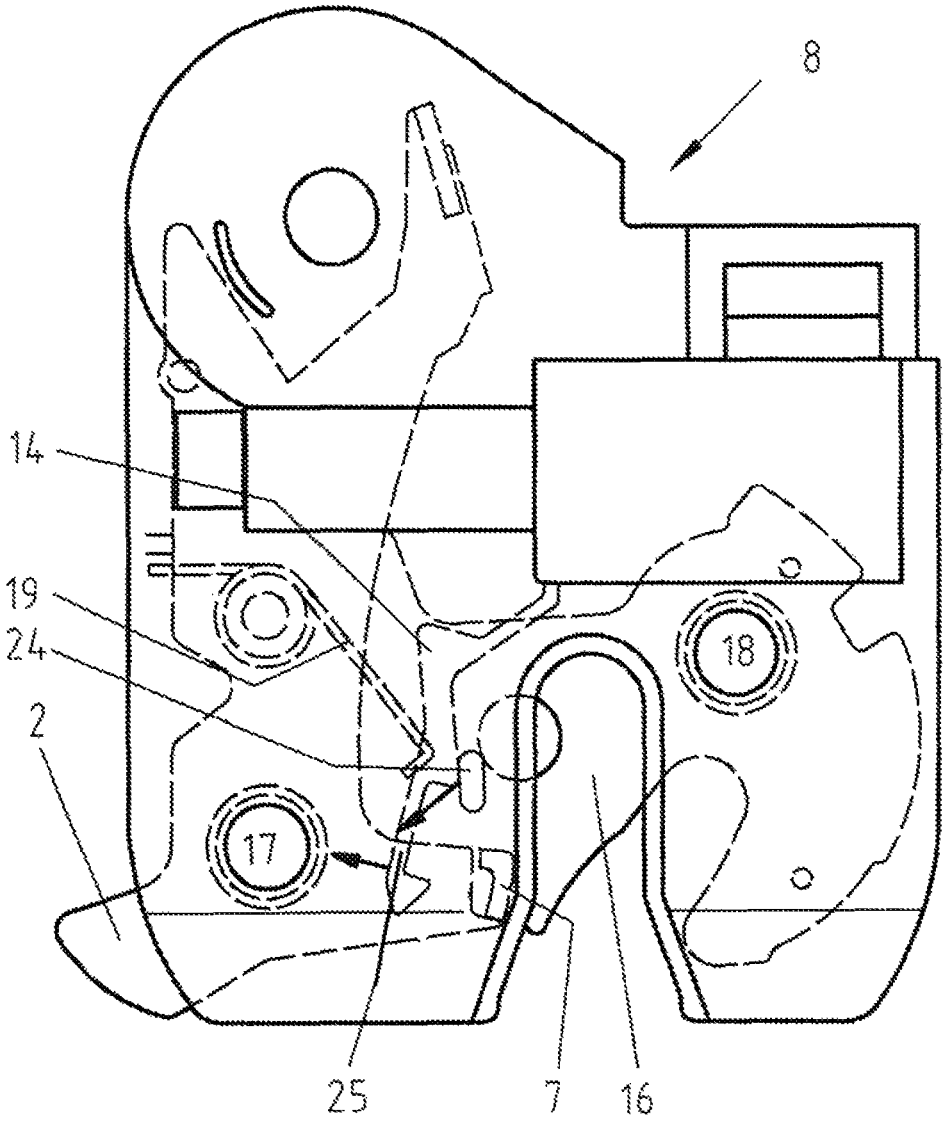

FIG. 8: Back view on the latch during opening of the locking mechanism;

FIG. 9: Front view on the latch during opening of the catch;

FIG. 10: Back view during opening of the catch;

FIG. 11: Front view on the latch in the open state of the locking mechanism;

FIG. 12: Back view on the latch in the open state of the locking mechanism;

FIG. 1 shows a pawl 1 preferably made of metal and a triggering lever 2 preferably made of metal for a latch in accordance with the invention. The pawl 1 is preferably pivotably connected with the triggering lever 2 by an axis 3. The axis 3 is advantageously a component of the triggering lever 2, in order thus to minimize the interplay between the triggering lever 2 and the pawl 1 which in particular enables exact relative movements between the triggering lever 2 and the pawl 1 and thus improves operational safety. The triggering lever 2 advantageously encompasses a towing arm contour 4, with which the pawl 1 can be moved out of its latching position. The towing arm contour 4 runs in particular in a step shape corresponding to a step-shaped protruding end 5 of the pawl 1. Furthermore, there remains a surface 15 on the end of the pawl 1, with which the catch can be latched.

If in the case of FIG. 1 the triggering lever 2 is pivoted parallel to the paper plane in a clockwise direction, the contour 4 grasps the protruding end 5 and also pivots the pawl 1 in a clockwise direction. Activation of the triggering lever 2 thus causes towing of the pawl 5 and thus moving the pawl 1 out of its latching position.

The axis 3 is preferably a cylindrical shape. Consequently, a bolting of a latch plate or a latch case of the latch can reach into the axis 3. Thus, the triggering lever 2 is pivotably attached to a latch plate or a latch case of the latch.

The triggering lever 2 preferably has an arm 6 which is equipped on the underside with a projection 7 on the free end. The arm with the towing arm contour 4 is advantageously relatively long compared to the length of the arm 6. For opening, an end area of this arm is grasped and pivoted with the towing arm contour 4. Due to the relatively long length, this occurs advantageously with relatively little force.

FIG. 2 shows an internal view of a latch cover 8 which is made of plastic in principle. Manufacture is generally as a single component in order to minimize the manufacturing and handling expense. The latch cover 8 has an intake area 9 in principle for a non-depicted locking bolt. The latch cover 8 comprises an accumulator lever 10. The accumulator lever 10 demonstrates a free and therefore movable end 11 and an end 12 attached to the latch cover 8. The material from which the latch cover is made has elastic characteristics. The end 11 of the accumulator lever 10 can therefore be pivoted around the fixing point, i.e. the fixed end 12. The geometry is advantageously selected in such a way that the accumulator lever 10 can be pivoted backwards and forwards parallel to the paper plane of FIG. 2 and thus parallel to the external wall 13 of the latch cover 8.

The perspective detail view in accordance with FIG. 3 clarifies that the accumulator lever 10 is located above the external housing cover wall or external wall 13 of the housing cover 8. A bridge area 14 includes a right angle with this external wall 13. The accumulator lever 10 is attached with its end 12 to this bridge 14. The accumulator lever 10 has a relatively large adjacent surface 14 for a leg spring 19, 20, 21. FIG. 3 shows that the accumulator lever 10 demonstrates a right-angled cross-section in sections, in particular a first arm section 15 which stretches starting from the fixed end 12 to the adjacent surface 14 and is connected in particular in a T-shape with the stop surface 14. The long sides of the right-angled cross-section preferably include a right angle with the wall 13. This promotes the possibility of pivoting in the paper plane. This means in the horizontal plane of the deflection of the accumulator lever of the fixed end 12 acting as a joint in FIG. 2.

Due to the T-shaped connection it is possible, despite little installation space, to provide a relatively large stop surface 14 on which a leg 19 of a spring can be reliably adjacent inter alia. In order to improve stability, two T-legs can be connected via an additional thin plastic surface, as is visible in FIG. 2, for example. Deviating from a T-shape, in a preferred execution form the arm 15 shown in FIG. 3 does not discharge at a right angle and/or centrally into the adjacent surface 14 shown in FIG. 3, but only approximately as shown in FIG. 2. Bordering onto the intake area 9 is the angle which includes the arm 15 with the adjacent surface 14, preferably greater than 90 degrees. This enables a better suited pivoting behavior of the accumulator lever 10.

FIG. 3 illustrates further details of a preferred execution form of the accumulator lever 10 in a perspective illustration.

FIG. 4 shows an external view of the housing cover 8 with the accumulator lever 10, the reverse side of which can be seen through a recess in the wall 13. The shape of the recess can correspond to the shape of the top view on the accumulator lever 10. For manufacturing technology reasons, such a recess is advantageous, but not absolutely necessary.

FIG. 5 shows the position of a catch 16 and of the triggering lever 2 in the latched state of the catch 16 in a top view of the inside of the latch cover 8. The catch 16 is latched in this position by the pawl 1 which is not depicted in FIG. 5 and in the following other figures. The triggering lever 2 can be pivoted around its axis 17 at a level which is below the level within which the catch 16 and the pawl 1 can be pivoted. The axis 17 is executed in particular by a bolt attached to a latch plate or a latch case. The catch 16 can be pivoted around its axis 18. The axis 18 is executed in particular by a bolt attached to a latch plate or a latch case. A leg 19 of a leg spring is adjacent in a pre-tensioned manner to the adjacent surface 14 of the accumulator lever and in particular in such a way that a force can be exerted in the direction of the intake area 9 on the accumulator lever 10. Another leg 20 of the spring is preferably adjacent to a bridge 22 of the latch cover 8 in a pre-tensioned manner in order to provide pre-tensioning. A coil 21 of the spring is held as shown in FIG. 6 by a protruding bolt 23 of the triggering lever 2 in an execution form. With little construction space, the spring is reliably held in a desired position.

FIG. 6 shows a top view of the outside of the latch cover 8, which is illustrated transparently in order to thus illustrate the holding of the springs 19, 20, 21 by the bolt 23. FIG. 6 further illustrates that in the latched state of the locking mechanism the free end 11 of the accumulator lever 10 is pressed against the protrusion 7 of the triggering lever 2 which is preferably angular and preferably into the angle of the protrusion 7 in such a way that the position of the triggering lever 2 is thus fixed by the accumulator lever. In order to facilitate this especially easily, the end 11 is preferably connected at a right angle with the adjacent pocket-shaped area 25. In FIG. 6 a protruding triggering contour 24 of the catch 16 can also be seen which protrudes in the direction of the triggering lever 2. This triggering contour 24 is advantageously arranged adjacent to the lever of the triggering lever 2 which demonstrates the towing arm contour 4.

In the latched state the latch surface 15 of the pawl 1 is adjacent to the latch surface 26 of the catch 16. FIGS. 5 and 6 show the case where the accumulator lever 10 exerts such a force on the triggering lever 2 that it can be moved in the non-triggering position shown here and is held in this non-triggering position. The accumulator lever thus advantageously contributes to suitably moving and/or holding the triggering lever.

In order to open the locking mechanism, the triggering lever 2 is now pivoted in a clockwise direction starting from FIG. 5. The open position of the triggering lever 2 as shown in FIG. 7 is attained. This in turn shows a top view of the inside of the latch cover 8. FIG. 8 shows the position of FIG. 7 seen from the outside of the latch cover 8. In turn, the latch cover 8 is shown transparently. If the triggering lever 10 reaches its open position shown in FIGS. 7 and 8, the angular-shaped protrusion 7 of the triggering lever 2 then reaches into a preferably pocket-shaped end area 25 of the accumulator lever 10. This occurs by pivoting of the accumulator lever 10 around the fixing point 12 of the accumulator lever 10. (In the case of the illustration in FIG. 7 in a clockwise direction, in the case of the illustration in FIG. 8 in an anti-clockwise direction). An envisaged latch connection then arises between the accumulator lever 10 and the triggering lever 2. The position of the triggering lever 2 is thus assured. The triggering lever 2 can now no longer be pivoted back into the position depicted in FIGS. 5 and 6. In the case of the illustration in FIG. 7 the triggering lever 2 can therefore no longer be pivoted in an anti-clockwise direction.

The pawl 1 not illustrated in FIGS. 7 and 8 is simultaneously moved into its open position by the towing arm contour 4. The catch 16 is therefore no longer latched. As the triggering lever 2 can no longer be pivoted back, the pawl 1 can no longer also be pivoted back into its latching position. This is prevented by holding of the end 5 of the pawl 1 by the towing arm contour 4 of the triggering lever 2. A latch with this locking mechanism can therefore then be reliably opened if an opening of a pertaining door or flap by a load, for example a snow load, is prevented.

As according to FIGS. 7 and 8 the catch 16 is no longer latched, it can pivot in the direction of its open position (in the case of the illustration in FIG. 7 in a clockwise direction, in the case of the illustration in FIG. 8 in an anti-clockwise direction). This pivoting is illustrated in FIGS. 9 and 10. FIG. 9 shows a top view of the inside of the latch cover 8. FIG. 10 shows a top view of the outside of the latch cover 8. In the case of FIG. 10 the latch cover 8 is depicted transparently in turn. If the catch 16 has reached its position shown in FIGS. 9 and 10, the triggering contour 24 seen from the leg spring 19 reaches the reverse side of the adjacent surface 14 of the accumulator lever 10. As the adjacent surface 14, as shown in FIG. 3, advantageously protrudes vis-à-vis the adjacent arm section 15 of the accumulator lever 10 in the direction of the catch 16, the triggering contour 24 can be moved by further pivoting of the catch in the opening direction along the reverse side of the adjacent surface 14. Due to this movement of the triggering contour 24 along the reverse side of the adjacent surface 14 the accumulator lever 10 is pivoted back contrary to the force of the pre-tensioned spring leg 19, namely in the case of the illustration in FIG. 10 contrary to the clockwise direction. As a result, the protrusion 7 of the triggering lever 2 is distanced from the pocket-shaped area 25 of the accumulator lever 10 or moved out of this pocket-shaped area 25. The latch connection between the accumulator lever 10 and the triggering lever 2 is thus lifted into its open position as a consequence of pivoting of the catch 16 (which is shown in FIGS. 11 and 12). FIG. 11 shows a top view of the inside of the latch cover 8. FIG. 12 shows a top view of the outside of the latch cover 8, whereby the latch cover 8 is depicted transparently.

The individual sections 15, 14, 25, 11 of the accumulator lever 10 are connected to one another at an angle as illustrated in order to be able to provide the depicted movement process in addition to the thus connected effects with special suitability. As illustrated in FIG. 3, a thin surface can also be provided for to promote stability which stabilizes the connection between the adjacent surface 14 and the pocket-shaped area 25 and/or between the pocket-shaped area 25 and the end 11. Such connecting surfaces are preferably provided for adjacent to the external wall 13 in order to enable a compact design.

During opening of a locking mechanism, the accumulator lever 10 therefore temporarily latches the triggering lever 2 and thus also the pawl 1 in such a way that the pawl 1 cannot be pivoted in its latching position in an unscheduled manner during opening of the catch. Such a locking mechanism can therefore also be reliably opened if the opening of a pertaining door or flap can be prevented by a load, such as a snow load. This latching position is deactivated again when the catch has reached its open position. This ensures that the catch 16 can now be latched again in a scheduled manner for closure of a pertaining door or flap.

REFERENCE SIGN LIST

1: Pawl,
2: Triggering lever;
3: Axis for the pawl;
4: Towing arm contour of the triggering lever;
5: Protruding end of the pawl;
6: Relatively short arm of the triggering lever;

7: Angular protrusion of the relatively short arm of the triggering lever;
8: Housing cover;
9: Intake area of the housing cover;
10: Accumulator lever;
11: Movable end of the accumulator lever;
12: Fixed end of the accumulator lever;
13: External wall of the latch cover;
14: Adjacent surface of the accumulator lever;
15: First arm section of the accumulator lever starting from the fixing point;
16: Catch;
17: Axis for mounting of the triggering lever;
18: Axis for mounting of the catch;
19: First leg of a spring;
20: Second leg of a spring;
21: Spring coil;
22: Bridge area of the latch cover for adjacency of a spring leg;
23: Bolting of the triggering lever for holding of a spring coil;
24: Triggering contour of the catch;
25: Pocket-shaped section of the accumulator lever;
26: Latch surface of the catch;
27: Bridge of the latch cover for fixing of the accumulator lever.

The invention claimed is:

1. A latch for a hood of a motor vehicle that extends horizontally, the latch comprising:

a locking mechanism having a catch that is moveable between a latched position and an unlatched position, and a pawl that is moveable between a closed position for latching the catch in the latched position and an open position in which the catch is moveable to the unlatched position;

a triggering lever that is moveable to move the pawl to the open position, thereby allowing the catch to move to the unlatched position;

an accumulator lever that is configured to engage and hold the triggering lever in a non-triggering position when the catch is in the latched position and in a triggering position in which the triggering lever temporarily holds the pawl in the open position, wherein the accumulator lever is a spring element formed of an elastic material and has a fixed end that is fixed within the latch and a movable end that is pivotable relative to the fixed end; and an additional spring separate from the accumulator lever that exerts a force on the accumulator lever to pivot the accumulator lever to a position in which the accumulator lever holds the triggering lever in the triggering position in which the triggering lever temporarily holds the pawl in the open position.

2. The latch according to claim 1, wherein the accumulator lever can be pivoted parallel to a pivoting plane of the locking mechanism and/or parallel to an external wall of a latch cover of the latch.

3. The latch according to claim 1, wherein the additional spring is made of metal.

4. The latch according to claim 1 further comprising a latch cover, wherein the accumulator lever is connected with the latch cover as a single component.

5. The latch according to claim 4, wherein the latch cover is made of plastic.

6. The latch according to claim 1, wherein the accumulator lever includes an attached first arm section which is connected in a T-shape and/or an angular shape with an adjacent area for the additional spring and/or for a triggering contour of the catch.

7. The latch according to claim 1, further comprising a latching connection between the accumulator lever and the triggering lever for the temporary holding of the pawl in the open position.

8. The latch according to claim 1, wherein the accumulator lever includes a pocket-shaped section in which the triggering lever enables the temporary holding of the pawl in the open position.

9. The latch according to claim 8, wherein the pocket-shaped section is connected in an angular shape with an adjacent area of the triggering lever.

10. The latch according to claim 8, wherein the movable end of the accumulator lever is connected in an angular shape with the pocket-shaped section.

11. The latch according to claim 1, wherein the triggering lever and the pawl are pivotably mounted around a common axis.

12. The latch according to claim 11, wherein the pawl is pivotably connected with the triggering lever along the common axis.

13. The latch according to claim 1, wherein the triggering lever includes a protruding towing arm contour for moving the pawl out of the closed position to the open position.

14. The latch according to claim 1, wherein the catch includes a triggering contour protruding from the catch through which the accumulator lever, after pivoting, can be pivoted back to a position in which the accumulator lever holds the triggering lever in the non-triggering position.

* * * * *